US009186783B2

(12) United States Patent
Wen et al.

(10) Patent No.: US 9,186,783 B2
(45) Date of Patent: Nov. 17, 2015

(54) AUTOMATIC BIT-CHANGING SCREWDRIVER

(75) Inventors: Hao Wen, Shanghai (CN); Junhua Shen, Shanghai (CN)

(73) Assignee: Shanghai Kunjek Handtools and Hardware Co., Ltd., Shanghai (CN)

( * ) Notice: Subject to any disclaimer, the term of this patent is extended or adjusted under 35 U.S.C. 154(b) by 0 days.

(21) Appl. No.: 14/238,453

(22) PCT Filed: Jan. 16, 2012

(86) PCT No.: PCT/CN2012/000074

§ 371 (c)(1),
(2), (4) Date: Jun. 17, 2014

(87) PCT Pub. No.: WO2013/023430

PCT Pub. Date: Feb. 21, 2013

(65) Prior Publication Data

US 2014/0290448 A1 Oct. 2, 2014

(30) Foreign Application Priority Data

Aug. 12, 2011 (CN) ..... 2011 1 0231204

(51) Int. Cl.
*B25B 23/00* (2006.01)
*B25B 15/00* (2006.01)
*B25G 1/08* (2006.01)

(52) U.S. Cl.
CPC ..... *B25B 23/0035* (2013.01); *B25B 15/00* (2013.01); *B25G 1/085* (2013.01)

(58) Field of Classification Search
CPC .... B25B 23/0035; B25B 15/00; B25B 15/02; B25B 15/008; B25B 15/007; B25B 13/54; B25B 23/106; B25B 23/108; B25B 23/08; B25B 23/105; B25G 1/085; B23B 51/08; B23B 227/16; B25F 1/04; B25F 1/02; B25F 1/00
USPC ..... 81/440, 439, 490, 442, 448, 449, 450, 81/58.4; 279/14; 408/239 R; 7/165, 168, 7/167
See application file for complete search history.

(56) References Cited

U.S. PATENT DOCUMENTS

| | | | | |
|---|---|---|---|---|
| 750,182 | A * | 1/1904 | Furbish | 7/168 |
| 1,616,300 | A * | 2/1927 | Bido | 81/438 |
| 7,237,987 | B2 * | 7/2007 | Hernandez et al. | 408/239 R |
| 2006/0254396 | A1 | 11/2006 | Hu | |

FOREIGN PATENT DOCUMENTS

| | | | |
|---|---|---|---|
| CN | 2207260 | Y | 9/1995 |
| CN | 101537606 | A | 9/2009 |
| JP | 8300270 | A | 11/1996 |

OTHER PUBLICATIONS

International Search Report for application No. PCT/CN2012/000074 dated Apr. 26, 2012.

* cited by examiner

*Primary Examiner* — Lee D Wilson
*Assistant Examiner* — Melanie Alexander
(74) *Attorney, Agent, or Firm* — Patterson & Sheridan LLP

(57) ABSTRACT

The present invention relates to an automatic bit-changing screwdriver including a bit tip and a bit shaft assembly. The bit tip and the bit shaft assembly are pivotably connected. Guided by the bit shaft assembly, the bit tip may rotate relative to the bit shaft assembly and change the tip without requiring direct manual contact with the bit tip. Particularly, the screwdriver includes a handle, a bit tip, a shaft and a shaft sleeve. The bit tip includes two sizes/styles of tips at two ends respectively. The bit tip is pivotably coupled to the shaft. The shaft is fixedly coupled to the handle. The shaft sleeve surrounds the shaft. The shaft and shaft sleeve are slidingly coupled together. Outwards sliding of the shaft sleeve drives the bit tip to rotate within the shaft to achieve bit-changing. A deep groove is formed on a front end of the shaft. The bit tip is disposed in the deep groove. A middle section of the shaft has a guide groove. The shaft sleeve is connected to the guide groove by a connecting element disposed along the guide groove. A slide guide block is fixedly positioned on the shaft sleeve facing a side of the shaft having the deep groove. The shaft sleeve has a notch. The notch is formed in a middle section of the shaft sleeve. A spring element is connected to the shaft sleeve. The spring element moves within the notch. The automatic bit-changing screwdriver provides a solution to a technical problem that the state of the art combination screwdrivers are generally inconvenient to change bits.

28 Claims, 5 Drawing Sheets

AUTOMATIC BIT-CHANGING SCREWDRIVER

TECHNICAL FIELD

The present invention relates to a hand tool, more particularly relates to an automatic bit-changing screwdriver.

BACKGROUND

Turn screws (i.e. screwdrivers for daily use) are extensively used to assembling and disassembling various work pieces. Currently combination screwdrivers are available to meet the need for assembling and disassembling work pieces of different style/sizes. Combination screwdrivers may be roughly divided into two categories.

The first category includes tips and shafts that are removable from handles. The bits or shafts and handles are stored separately. Different screwdrivers may be formed by changing bits or shafts. This category of combination screwdrivers are suitable for a wide range of applications and are practical. However, bits or shafts that are not in use need specific space for storage, thus requiring extra space and inconvenient to carry around and use. Additionally, bits or shafts may be easily lost when not properly stored.

The second category includes built-in storage. Different screwdrivers may be formed by switching the tip or shaft using a mechanical structure or other means. This category of combination screwdrivers require small storage space, and easy to carry. Bits or shafts that are switched off are not easily lost. However storing multiple bits or shafts together usually results in complex inner structures and makes it inconvenient to change bits or shafts.

For example, Chinese invention patent application serial No. 200910049964.4 discloses a unitary combination screwdriver. FIG. 1 illustrates the structure of one embodiment of the unitary combination screwdriver. The body of the screwdriver is assembled from a cylindrical plastic handle sleeve 25, a hexagonal metal shaft sleeve 24, a metal clamp head 23, and a plastic protective cover 22 for protecting screwdriver bits 21. The threaded clamp head 23 is magnetic. The handle is hollow and is formed to a standard size so that various types of screwdriver bits 21 can be stacked and inserted inside the screwdriver. This type of unitary combination screwdriver overcomes the disadvantages of ordinary combination screwdrivers, i.e. separate storage for screwdriver body and screwdriver bits, thus effectively reducing the overall volume of the screwdriver. The unitary combination screwdrivers match different types of screws by simply changing the order of the embedded screwdriver bits. However, it is inconvenient to change screwdriver bits since the screwdriver bits 21 are stored inside the shaft sleeve 24 in a stacked manner. For example, to use the screwdriver bit that is stored in the back of the shaft sleeve 24, it is necessary to remove the multiple screwdriver bits positioned over the needed screwdriver bit. The operation is complicated and severely reduces operating efficiency.

For example, Chinese utility model patent No. 201020185037.3 discloses an automatic bit-changing screwdriver, which includes an outer shield, an inner shield, a shaft, a shaft guiding base, a plurality of guiding shaft elements and a bit guiding sleeve. The inner shield and outer shield are slidingly coupled to each other. The shaft is disposed inside the inner shield and the outer shield. The shaft is fixedly connected to the outer shield to push or pull the bit. The shaft has a sloped surface. A shaft leading magnet is disposed on a front end of the shaft. The shaft guiding base is disposed between the inner shield and the shaft and fixedly attached to a back end of the inner shield. The plurality of guide shaft elements are connected along a periphery of the shaft guiding base and rotationally coupled to the shaft guiding base. Each guiding shaft element has a convex arc surface corresponding to a perspective position on the sloped surface. However the multiple bits of the screwdriver result in a complicated inner structure. Further because all the bits are disposed in the bit guiding sleeve, a needed bit cannot be obtained by one pump.

In conclusion, the state of the art combination screwdrivers are generally inconvenient for bit-changing and usually require operators to touch the bits by hand during bit-changing, thus, causing contamination, erosion and rust.

DISCLOSURE OF THE INVENTION

The automatic bit-changing screwdriver provides a solution to a technical problem that the state of the art combination screwdrivers are generally inconvenient to change bits. Additionally, the automatic bit-changing screwdriver also provides a technical solution to reduce contamination, erosion and rust on the bits caused by direct contact with human hands.

The present invention provides an automatic bit-changing screwdriver to solve the above technical problems. The automatic bit-changing screwdriver includes a bit tip and a bit shaft assembly. The bit tip and the bit shaft assembly are pivotably connected. The bit shaft assembly operates upon the bit tip to rotate the bit tip in the bit shaft assembly thus achieve bit-changing without requiring direct manual contact of the bit tip.

In one embodiment, each of two ends of the bit tip comprises a tip respectively.

In one embodiment, the bit shaft assembly comprises a plurality of bit rotating assisting elements. When the bit shaft assembly is being operated, the bit rotating assisting elements rotate the bit tip to perform bit-changing.

In one embodiment, the bit shaft assembly comprises a shaft, a shaft sleeve, and a handle. The shaft is pivotably coupled to the bit tip. The shaft and the handle are fixedly coupled together. The shaft sleeve and the shaft are coupled by sliding connection. Outward sliding of the shaft sleeve drives the bit tip to rotate within the shaft and achieve bit-changing.

In one embodiment, a deep groove is formed on a front end of the shaft. The deep groove allows the bit tip to freely rotate therein, and the bit tip is disposed in the deep groove.

In one embodiment, the deep groove is formed by two sidewalls. Each of the two sidewalls has a hole on an end, and the bit tip is connected in the deep groove by an axle pin.

In one embodiment, a middle section of the shaft has a guide groove as a trip guide for the back and forth movement of the shaft sleeve. The shaft sleeve is connected to the guide groove by a connecting element disposed along the guide groove.

In one embodiment, the shaft sleeve has a notch to provide space needed for the bit tip to rotate. The notch is formed in a middle section of the shaft sleeve.

In one embodiment, the bit rotation assisting elements comprise a slide guide block. The slide guide block is fixedly positioned on the shaft sleeve facing a side of the shaft having the deep groove.

In one embodiment, the bit rotation assisting elements comprise a spring element. The spring element is connected to the shaft sleeve, and the spring element moves within the notch.

In one embodiment, the shaft has a stepped shape. A diameter of a back section of the shaft is larger than a diameter of a front section of the shaft.

In one embodiment, the back section of the shaft is squared.

In one embodiment, a back end of the shaft sleeve has a squared hole matching the back section of the shaft.

In one embodiment, a front end of the shaft sleeve has a hexagonal hole, and the hexagonal hole matches the bit tip.

In one embodiment, the spring element is a spring strip.

In one embodiment, a first end of the spring strip comprises a planar structure, a second end of the spring strip comprises a curved structure, the planar structure is fixedly secured to the shaft sleeve, and the curved structure is disposed in the notch of the shaft sleeve.

In one embodiment, a shaft sleeve outer cover is fixedly coupled to and enclosing the shaft sleeve.

Embodiments of the present invention also provide an automatic bit-changing screwdriver. The automatic bit-changing screwdriver includes a handle, a bit tip, a shaft, and a shaft sleeve. The bit tip has a tip on each of two ends. The bit tip is pivotably coupled to the shaft. The shaft is fixedly coupled to the handle. The shaft sleeve surrounds the shaft. The shaft and shaft sleeve are slidingly coupled together. Outwards sliding of the shaft sleeve drives the bit tip to rotate within the shaft to achieve bit-changing.

In one embodiment, a deep groove is formed on a front end of the shaft. The deep groove allows the bit tip to freely rotate therein. The bit tip is disposed in the deep groove.

In one embodiment, the deep groove is formed by two sidewalls. Each of the two sidewalls has a hole on an end. The bit tip is connected in the deep groove by an axle pin.

In one embodiment, a middle section of the shaft has a guide groove as a trip guide for the back and forth movement of the shaft sleeve. The shaft sleeve is connected to the guide groove by a connecting element disposed along the guide groove.

In one embodiment, a slide guide block is fixedly positioned on the shaft sleeve facing a side of the shaft having the deep groove. The shaft sleeve has a notch to provide space needed for the bit tip to rotate. The notch is formed in a middle section of the shaft sleeve. A spring element is connected to the shaft sleeve. The spring element moves within the notch.

In one embodiment, the shaft has a stepped shape. A diameter of a back section of the shaft is larger than a diameter of a front section of the shaft.

In one embodiment, the back section of the shaft is squared.

In one embodiment, a back end of the shaft sleeve has a squared hole matching the back section of the shaft.

In one embodiment, a front end of the shaft sleeve has a hexagonal hole. The hexagonal hole matches the bit tip.

In one embodiment, the spring element is a spring strip.

In one embodiment, a first end of the spring strip comprises a planar structure, a second end of the spring strip comprises a curved structure, the planar structure is fixedly secured to the shaft sleeve, and the curved structure is disposed in the notch of the shaft sleeve.

In one embodiment, a shaft sleeve outer cover is fixedly coupled to and enclosing the shaft sleeve.

Compared to the existing technology, the present invention provides the following technical advantages:

The present invention provides an automatic bit-changing screwdriver. When the shaft sleeve is pushed outwards, the spring strip fixedly attached to the shaft sleeve is pushed out with the shaft sleeve. When the spring strip presses the bit tip rotates about the axle pin out of the notch of the shaft sleeve. After the bit tip rotates out, the shaft sleeve is pulled back, the slide guide block fixed to the shaft sleeve presses against another tip of the bit tip so that the bit tip rotates about the axle pin until parallel with the shaft. The shaft sleeve continues to move back while the bit tip follows the guide block until the bit tip extends out of the shaft sleeve, thus complete one bit-changing. The automatic bit-changing screwdriver is simple and compact in structure, does not require direct manual contact during bit-changing. Bit-changing can be achieved by operating structures other than the bit tip, thus preventing contamination, erosion and rust on the bits caused by direct contact with human hands.

DETAILED DESCRIPTION

The present invention provides an automatic bit-changing screwdriver having a bit tip and a bit shaft assembly. The bit tip and the bit shaft assembly are pivotably connected. Guided by the bit shaft assembly, the bit tip may rotate relative to the bit shaft assembly and change the tip without requiring hands of the operation to be in direct contact with the bit tip.

According to the present invention, the bit tip includes two sizes/styles of bits at two ends. The bit shaft assembly includes a plurality of bit rotation assisting elements. During operation, the bit can be automatically changed by operating the bit shaft assembly alone. The automatic bit-changing is achieved by using the bit rotation assisting elements of the bit tip shaft assembly to manipulate the bit tip without requesting human hand to operate the bit tip.

An exemplary embodiment of the present invention is herein described in detail to demonstrate how to automatically changing bits without requesting human hand to operate a bit tip. In this embodiment, the bit shaft assembly includes a shaft, a shaft sleeve, and a handle. The bit tip is pivotably coupled to the shaft. The shaft is fixedly coupled to the handle. The shaft sleeve and the shaft are coupled by sliding connection. The shaft sleeve slides outwards driving the bit tip to rotate in the shaft and change the bit tip. In this embodiment, the bit rotation assisting elements include a slide guide block fixedly disposed on the shaft sleeve corresponding to the side of a deep groove in the shaft. The bit rotation assisting elements further include a spring element coupled to the shaft sleeve and movable within a notch.

It goes without saying that the above embodiment is only one example of the present invention. The present invention is not limited to the above embodiment. Any technical solution that uses structures to operate and changing a bit tip without the bit tip to be in direct contact with human hand is within the scope of the present invention.

Detailed description of the embodiment is described with the following figures.

Figure 1:
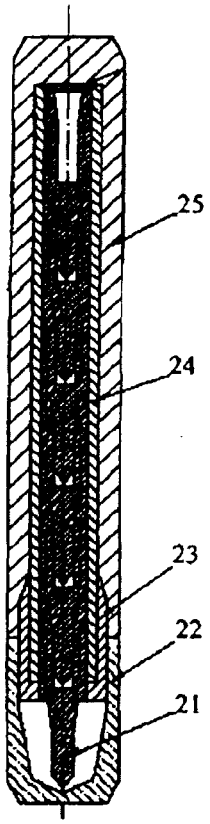
Figure 1 (PRIOR ART)
FIG. 1 is a schematic structural representation of existing technology.
Figure 2:
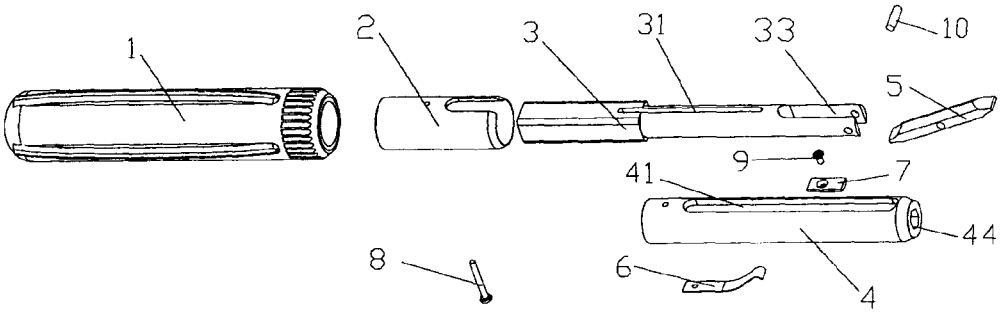
FIG. 2 is an exploded view of an automatic bit-changing screwdriver according to the present invention.
Figure 3:
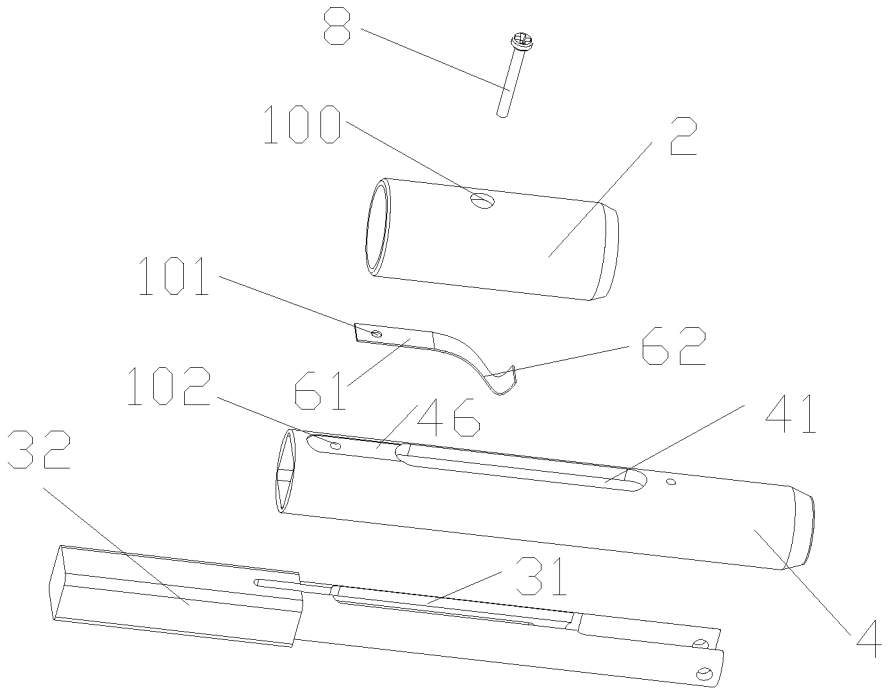
FIG. 3 is a schematic partial exploded view of the automatic bit-changing screwdriver according to the present invention.
Figure 4:
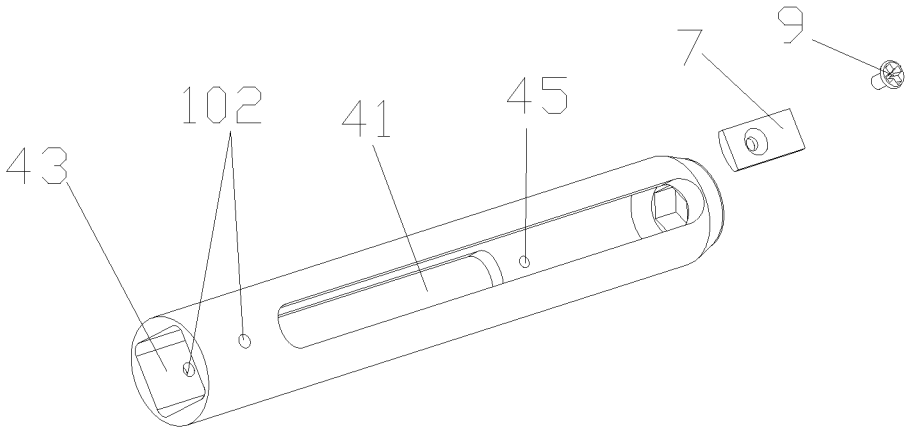
FIG. 4 is a schematic exploded view of a shaft sleeve of the automatic bit-changing screwdriver according to present invention.

FIGS. 2, 3 and 4 show an automatic bit-changing screwdriver. A shaft 3 is fixedly coupled to a handle 1. A front end of the shaft 3 has a deep groove 33. The deep groove 33 has two opposing side walls. The two side walls define a space in between to allow a bit tip 5 to rotate. Each of the two side walls has a wall hole (a through hole). The bit tip 5 also has a through hole formed in a central section. The bit tip 5 and the shaft 3 are coupled by an axle pin 10 disposed sequentially through the wall hole, the through hole, and the wall hole. The shaft 5 has a guide groove 31 formed in a middle section. The guide groove 31 is a rectangular shaped through hole. The guide groove 31 functions as a trip guide to ensure that a shaft sleeve 4 moves back and forth relatively to the shaft 3, i.e., the shaft sleeve 4 can only move within the length of the guide groove 31 of the shaft 3. The shaft 3 has a stepped shape. In the present embodiment, the shaft 3 has two steps. The front and middle section of the shaft 3 is a first step 34 and a back section of the shaft 3 is a second step 32. The second step 32 is squared and the first step 34 is circular. Length/width of the second step 32 is larger than a diameter of the first step 34. In other words, the diameter (length or width of the second step 34) of the back section of the shaft 3 is a larger than the diameter of the front section of the shaft 3.

In the present invention, the bit tip 5 has two tips of different size and/or style for fastening screws of different size/style. In the present embodiment, because the bit tip 5 is connected to the shaft 3 by the axle pin 10, it is convenient to assemble and disassemble, thus convenient to changing different bit tip 5 to use with the screwdriver.

A shaft sleeve 4 is disposed outside the shaft 3, i.e. the shaft sleeve 4 surrounds the shaft 3 and is connected to the shaft 3 by sliding connection. The shaft sleeve 4 is a hollow cylindrical pipe. The shaft sleeve 4 has a notch 41. The notch 41 is formed in a middle section of the shaft sleeve 4. The notch 41 functions to provide space needed for the bit tip 5 to rotate. The notch 42 also aligns with the deep groove 33 of the shaft 3 when the shaft sleeve 4 is sliding. A front end of the shaft sleeve 4 has a hexagonal opening 44, i.e. the hexagonal opening 44 is an opening in the shape of hexagon to match the bit tip 5. A slide guide block 7 is fixedly coupled to the shaft sleeve 4 on the side corresponding to the deep groove 33. The slide guide block 7 is fixedly mounted to the shaft sleeve 4 by a screw 9. The slide guide block 7 is positioned between the shaft sleeve 4 and the shaft 3, and within the deep groove 33 of the shaft 3. A hole 45 is formed on a front section of the shaft sleeve 4. The slide guide block 7 is fixed to the hole 45 by the screw 9. The shaft sleeve 4 also includes a spring element coupled thereon. In one embodiment, the spring element is a spring strip 6. Of course, the spring element may be other structure that functions as a spring device. The present invention does not limit the spring element to be a spring strip. One end of the spring strip 6 may be a planar structure 61. Another end of the spring strip 6 may be a curved structure 62. The planar structure 61 is fixedly coupled to the shaft sleeve 4 (The shaft sleeve 4 has a planar spring anchor point 46 connected to a back section of the notch 41. The planar structure 61 of the spring strip 7 is fixedly coupled to the spring anchor point 46 and secured by a screw 8). The curved structure 62 is disposed within the notch 41 of the shaft sleeve 4. According to the present invention, the notch 41 is a through slot, i.e. a through hole along an axial direction of the shaft sleeve 4.

A shaft sleeve outer cover 2 encloses a back end of the shaft sleeve 4. The shaft sleeve outer cover 2 is fixedly coupled to the shaft sleeve 4. According to the present invention, through holes of the same size are formed on back ends of the shaft sleeve outer cover 2, the spring strip 6, the shaft sleeve 4 (a through hole 100 on the shaft sleeve outer cover, a through hole 101 on the spring strip, and a through hole 102 on the shaft sleeve). A long screw 8 sequentially inserts through the through holes (the through hole 100 on the shaft sleeve outer cover, the through hole 101 on the spring strip, and the through hole 102 on the shaft sleeve) and the guide groove 31 of the shaft 3. During the process of assembly, the shaft sleeve outer cover 2, the spring strip 6, the shaft sleeve 4 are fixedly coupled together and then move in unison to slide along the guide groove 31.

Figure 5A:
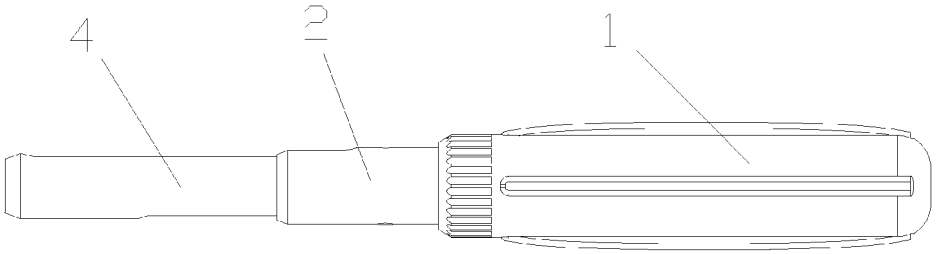
FIG. 5A is a view of the automatic bit-changing screwdriver of the present invention when not in use.
Figure 5B:
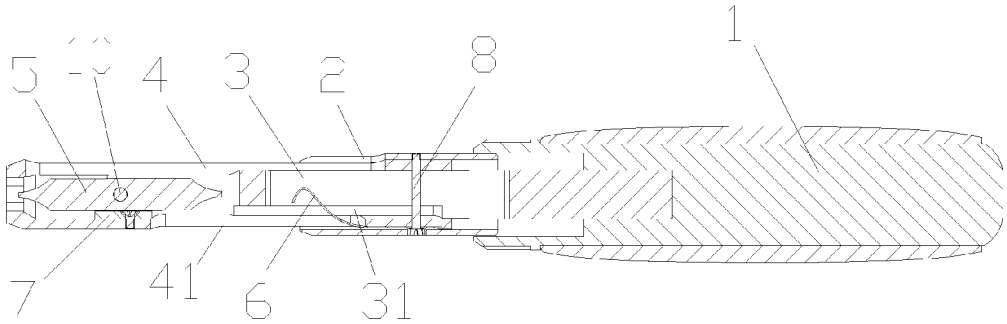
FIG. 5B is a schematic sectional view of the automatic bit-changing screwdriver of the present invention when not in use.

The operation for automatic bit-changing is as following:

FIGS. 5A and 5B illustrate the screwdriver at a non-operating state. The bit tip 5 is positioned within the deep groove 33 of the shaft 3 and the shaft 3 is positioned within the shaft sleeve 4.

Figure 6A:
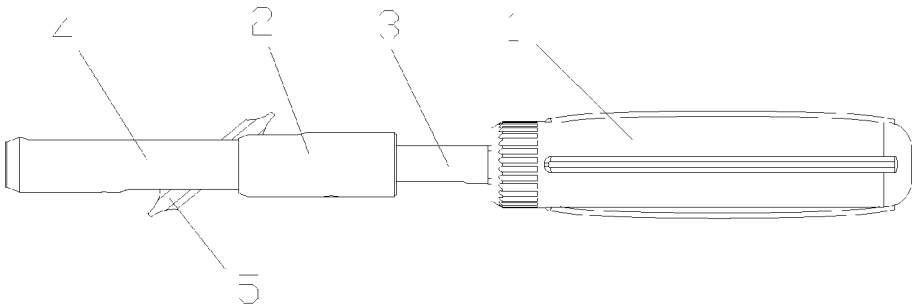
FIG. 6A is a view of the automatic bit-changing screwdriver of the present invention when the shaft sleeve is pushed out.
Figure 6B:
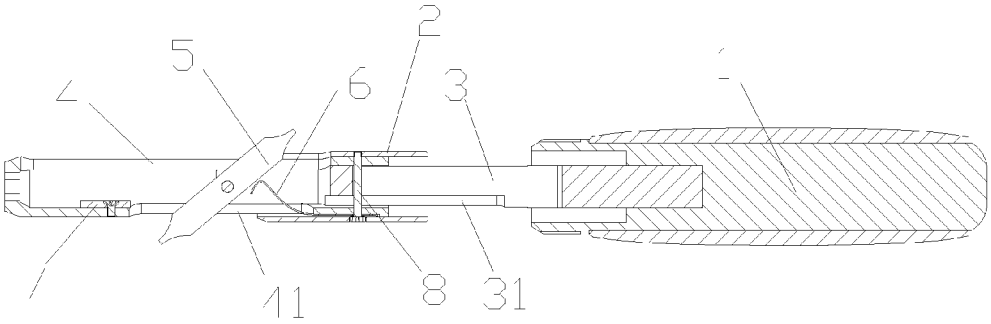
FIG. 6B is a schematic sectional view of the automatic bit-changing screwdriver of the present invention when the shaft sleeve is pushed out.

As shown in FIGS. 6A and 6B, as the shaft sleeve 4 is pushed outward, the spring strip 6 fixed on the shaft sleeve 4 is also pushed outward and presses against the bit tip 5. The bit tip 5 rotates about the axle pin 10 and comes out of the notch 41 of the shaft sleeve 4.

Figure 7A:
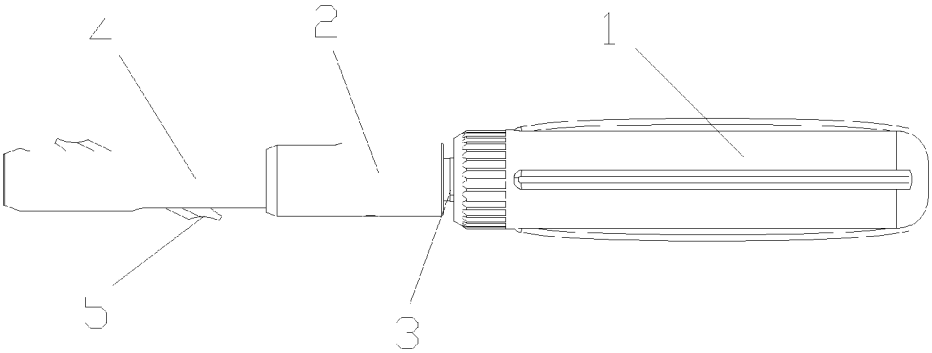
FIG. 7A is a view of the automatic bit-changing screwdriver of the present invention when the shaft sleeve is returning to the original position.
Figure 7B:
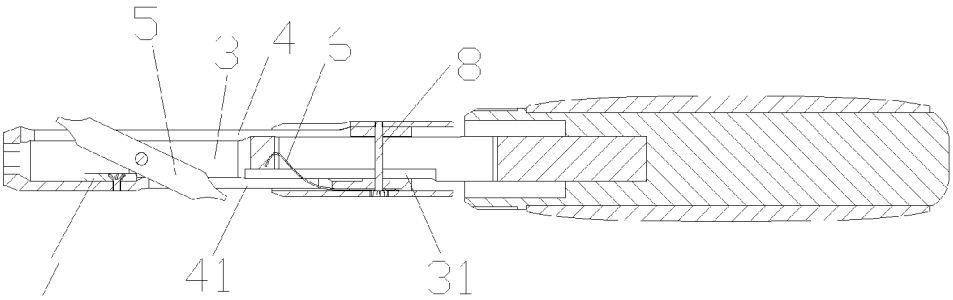
FIG. 7B is a schematic sectional view of the automatic bit-changing screwdriver of the present invention when the shaft sleeve is returning to the original position.

As shown in FIGS. 7A and 7B, after the bit tip 5 rotates out, the shaft sleeve 4 is moved back, the slide guide block 7 fixed on the shaft sleeve 4 presses the other end of the bit tip 5 causing the bit tip 5 to rotate about the axle pin 10 until the bit tip 5 is parallel to the shaft, i.e. positioned in the deep groove 33 of the shaft 4 (please refer to FIGS. 5A and 5B).

Figure 8A:
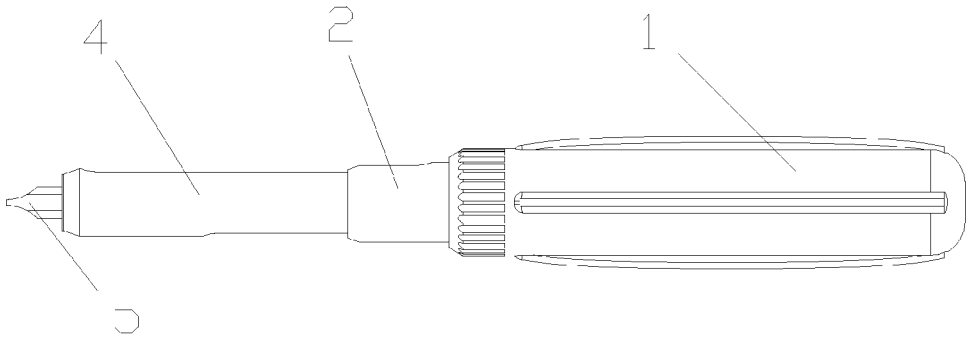
FIG. 8A is a view of the automatic bit-changing screwdriver of the present invention after bit-changing.
Figure 8B:
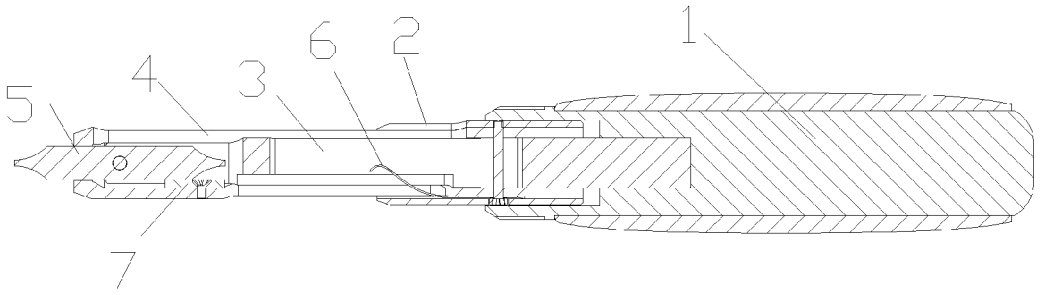
FIG. 8B is a schematic sectional view of the automatic bit-changing screwdriver of the present invention after bit-changing.

As shown in FIGS. 8A and 8B, while the shaft sleeve 4 is moved further back, the bit tip 5 moves backwards along the fixed slide guide block 7 until the bit tip 5 extends out of the shaft sleeve 4, thus, complete one change.

The above disclosure is only one embodiment of the present invention. The present invention is not limited to the above embodiment. Any change devised by persons skilled in the art falls within the scope of protection of the present invention.

The invention claimed is:

1. An automatic bit-changing screwdriver, comprising:

a bit tip; and a bit shaft assembly comprising:

a shaft;

a shaft sleeve, wherein the shaft is pivotably coupled to the bit tip, and the shaft sleeve and the shaft are coupled by sliding connection; and one or more bit rotation assisting elements, wherein the one or more bit rotation assisting elements are connected to the shaft sleeve, and sliding of the shaft sleeve causes the one or more bit rotation assisting elements to contact the bit tip and drive the bit tip to rotate in the bit shaft assembly thus achieve bit-changing without requiring direct manual contact of the bit tip.

2. The automatic bit-changing screwdriver of claim 1, wherein each of two ends of the bit tip comprises a tip respectively.

3. The automatic bit-changing screwdriver of claim 1, wherein the bit shaft assembly further comprises:

a handle, wherein the shaft and the handle are fixedly coupled together, and outward sliding of the shaft sleeve drives the bit tip to rotate within the shaft and achieve bit-changing.

4. The automatic bit-changing screwdriver of claim 3, wherein a deep groove is formed on a front end of the shaft, the deep groove allows the bit tip to freely rotate therein, and the bit tip is disposed in the deep groove.

5. The automatic bit-changing screwdriver of claim 4, wherein the deep groove is formed by two sidewalls, each of the two sidewalls has a hole on an end, and the bit tip is connected in the deep groove by an axle pin.

6. The automatic bit-changing screwdriver of claim 3, wherein a middle section of the shaft has a guide groove as a trip guide for the back and forth movement of the shaft sleeve, and the shaft sleeve is connected to the guide groove by a connecting element disposed along the guide groove.

7. The automatic bit-changing screwdriver of claim 3, wherein the shaft sleeve has a notch to provide space needed for the bit tip to rotate, and the notch is formed in a middle section of the shaft sleeve.

8. The automatic bit-changing screwdriver of claim 4 wherein the one or more bit rotation assisting elements comprise a slide guide block, the slide guide block is fixedly positioned on the shaft sleeve facing a side of the shaft having the deep groove.

9. The automatic bit-changing screwdriver of claim 7, wherein the one or more bit rotation assisting elements comprise a spring element, the spring element is connected to the shaft sleeve, and the spring element moves within the notch.

10. The automatic bit-changing screwdriver of claim 3, wherein the shaft has a stepped shape, and a diameter of a back section of the shaft is larger than a diameter of a front section of the shaft.

11. The automatic bit-changing screwdriver of claim 10, wherein the back section of the shaft is squared.

12. The automatic bit-changing screwdriver of claim 3 or 11, wherein a back end of the shaft sleeve has a squared hole matching the back section of the shaft.

13. The automatic bit-changing screwdriver of claim 3, wherein a front end of the shaft sleeve has a hexagonal hole, and the hexagonal hole matches the bit tip.

14. The automatic bit-changing screwdriver of claim 9, wherein the spring element is a spring strip.

15. The automatic bit-changing screwdriver of claim 14, wherein a first end of the spring strip comprises a planar structure, a second end of the spring strip comprises a curved structure, the planar structure is fixedly secured to the shaft sleeve, and the curved structure is disposed in the notch of the shaft sleeve.

16. The automatic bit-changing screwdriver of claim 3, further comprising a shaft sleeve outer cover fixedly coupled to and enclosing the shaft sleeve.

17. An automatic bit-changing screwdriver, comprising:

a handle;

a bit tip;

a shaft; and a shaft sleeve, wherein the bit tip has a tip on each of two ends, the bit tip is pivotably coupled to the shaft, the shaft is fixedly coupled to the handle, the shaft sleeve surrounds the shaft, the shaft and shaft sleeve are slidingly coupled together; and one or more bit rotation assisting elements, wherein the one or more bit rotation assisting elements are connected to the shaft sleeve, and outwards sliding of the shaft sleeve causes the one or more bit rotation assisting elements to contact the bit tip and drive the bit tip to rotate within the shaft to achieve bit-changing without requiring direct manual contact of the bit tip.

18. The automatic bit-changing screwdriver of claim 17, wherein a deep groove is formed on a front end of the shaft, the deep groove allows the bit tip to freely rotate therein, and the bit tip is disposed in the deep groove.

19. The automatic bit-changing screwdriver of claim 18, wherein the deep groove is formed by two sidewalls, each of the two sidewalls has a hole on an end, and the bit tip is connected in the deep groove by an axle pin.

20. The automatic bit-changing screwdriver of claim 17, wherein a middle section of the shaft has a guide groove as a trip guide for the back and forth movement of the shaft sleeve, and the shaft sleeve is connected to the guide groove by a connecting element disposed along the guide groove.

21. The automatic bit-changing screwdriver of claim 17 or 18, wherein the one or more bit rotation assisting elements comprise a slide guide block is fixedly positioned on the shaft sleeve facing a side of the shaft having the deep groove, the shaft sleeve has a notch to provide space needed for the bit tip to rotate, and the notch is formed in a middle section of the shaft sleeve, a spring element is connected to the shaft sleeve, and the spring element moves within the notch.

22. The automatic bit-changing screwdriver of claim 17, wherein the shaft has a stepped shape, and a diameter of a back section of the shaft is larger than a diameter of a front section of the shaft.

23. The automatic bit-changing screwdriver of claim 22, wherein the back section of the shaft is squared.

24. The automatic bit-changing screwdriver of claim 17 or 23, wherein a back end of the shaft sleeve has a squared hole matching the back section of the shaft.

25. The automatic bit-changing screwdriver of claim 17, wherein a front end of the shaft sleeve has a hexagonal hole, and the hexagonal hole matches the bit tip.

26. The automatic bit-changing screwdriver of claim 21, wherein the spring element is a spring strip.

27. The automatic bit-changing screwdriver of claim 26, wherein a first end of the spring strip comprises a planar structure, a second end of the spring strip comprises a curved structure, the planar structure is fixedly secured to the shaft sleeve, and the curved structure is disposed in the notch of the shaft sleeve.

28. The automatic bit-changing screwdriver of claim 17, further comprising a shaft sleeve outer cover fixedly coupled to and enclosing the shaft sleeve.

* * * * *